US005636622A

United States Patent [19]

Urcelay Amondarain et al.

[11] Patent Number: 5,636,622

[45] Date of Patent: Jun. 10, 1997

[54] COMMERCIAL GAS OVEN FOR COMBINED COOKING

[75] Inventors: Eugenio Urcelay Amondarain; Miguel Maillo Martin, both of Mondragon; Eugenio Ayerbe Oyarbide, Zumarraga, all of Spain

[73] Assignees: Fagor, S Coop, Mondragon; Gas Natural SDG, S.A., Barcelona; Repsol Butano, S.A., Madrid, all of Spain

[21] Appl. No.: 666,707

[22] Filed: Jun. 18, 1996

[51] Int. Cl.[6] ..... A21B 1/08

[52] U.S. Cl. ..... 126/20; 126/21 R; 99/468

[58] Field of Search ..... 126/20, 369, 20.1, 126/20.2, 34, 344, 21 A; 99/467, 473, 474, 476, 468; 426/510, 511; 219/401

[56] References Cited

U.S. PATENT DOCUMENTS

| | | | |
|---|---|---|---|
| 2,524,272 | 10/1950 | Sage | 126/20 |
| 5,016,605 | 5/1991 | LaForet et al. | 126/20 |
| 5,080,087 | 1/1992 | McFadden et al. | 126/20 |
| 5,215,000 | 6/1993 | Desage et al. | 126/20 |
| 5,517,980 | 5/1996 | Cappello et al. | 126/20 |
| 5,530,223 | 6/1996 | Culzoni et al. | 126/20 |

*Primary Examiner*—James C. Yeung
*Attorney, Agent, or Firm*—The Kline Law Firm

[57] ABSTRACT

A commercial gas oven has as its only source of heat for heating and for steam generating an extended mesh-type burner and a sealed combustion chamber. The oven works in five cooking modes reaching steam saturation below 100° C. and a high humidity up to 250° C., combining air convection from a central turbine and the steam which is generated into the oven. At least one steam generator duct conveys the combustion fumes around a central turbine on whose surface falls the water sprayed from a sprayer linked to the turbine. The fumes are recovered to contribute to heating the cooking chamber by means of a takeup box.

9 Claims, 4 Drawing Sheets

COMMERCIAL GAS OVEN FOR COMBINED COOKING

BACKGROUND OF THE INVENTION

1. Field of the Invention

This invention relates to a commercial cooking oven heated by gas to generate steam and hot air, and in particular to the means for generating the heat, generating the steam, supplying the fuel mixture, feeding of water for generating the steam, and exhausting the fumes and steam.

2. Prior Art

Patent EP-0 244 538 describes a cooking oven which incorporates an air turbine and a cylindrical water sprayer for generating steam coupled to the turbine shaft, fed by a line through a solenoid valve controlled by a cooking mode selector. This water sprayer is positioned inside the air turbine and throws off water droplets tangentially, and it is fed with cold water from the line.

The oven described in patent EP-0 277 888 incorporates a gas burner fed by an air/gas mixing device with a blower and one common duct for exhausting the fumes from combustion and the steam. The steam generator is independent, and it is separate from the burner, since it is powered by electricity. When the flame is extinguished, condensation is prevented from forming on the burner and the electrodes by a second air current through the burner feed duct. The second air current is heated by an auxiliary source.

In known gas ovens, the heater of the air that warms the food and the heater of the water that generates the steam are independent, and the full power of the gas burner is used to heat the air, being complemented by electric power to generate the steam. To keep steam from entering the gas burner and its feeding duct, and to keep moisture out of their control electrodes, known ovens use additional means unrelated to the burner.

SUMMARY OF THE INVENTION

The object of the invention is a commercial gas cooking oven that combines the hot air convection and steam cooking modes at different high and low temperatures.

The commercial that is the oven object of the present invention uses only energy provided by gas combustion, solving the problem of procuring the oven's full heating power from a single high-performance burner. Therefore the heat of the fumes released in combustion must be used both to generate steam and to heat the oven atmosphere.

Furthermore, to achieve the necessary quantity of steam to saturate the cooking chamber at a temperature of close to 100° C., a large hot surface is needed to vaporize the water, and a high temperature is needed to heat the surface. The oven claimed obtains a large amount of absolute humidity in the atmosphere of the cooking chamber to achieve the saturation of the cooking chamber at a temperature very close to 100° C. It achieves high combustion performance by means of a gas burner of small dimensions, procuring the necessary power to generate at the same time the hot air and the steam in the cooking chamber by using a sealed combustion chamber and means for exhausting the combustion fumes to generate steam, which means also characterize the oven claimed.

The oven achieves a high degree of relative humidity in the cooking chamber at any temperature up to 250° C., and, for this reason, to the three known modes of cooking in the oven described in the main patent application, the "convection mode" of high-temperature air blown out by a central turbine at up to 250° C., the "steam mode" at 99° C., and the "combined mode" of convection and steam: two additional cooking modes have been added, the "regeneration mode," with blowing air but an atmosphere whose relative humidity is near saturation in a preferred temperature range of 50° to 175° C., and the "low temperature steam mode" between 50° and 99° C. The "regeneration mode" reheats prepared food without drying it out, while the saturated "low temperature steam" mode is for cooking of some specific food types.

The oven which is the object of the present invention comprises an oven structure made up of a number of panels and walls, including an intermediate wall defining the cooking chamber, a rear oven part and a side housing surrounding the cooking chamber. A control panel on the oven door includes a cooking mode selector.

An extended mesh-type gas burner provides a flame distributed uniformly along its length, and has a high power relative to its length. The burner is provided with a blower. There is also a device for supplying the fuel mixture to the burner that draws in air from outside the oven through a flexible duct holding an intercalated air filter. The filter keeps the burner mesh from becoming blocked, and the blower homogenizes the air/gas premixture.

A sealed combustion chamber is located on the floor of the cooking chamber attached to the intermediate wall, and it provides a high temperature to the combustion fumes and isolates the burner from the moisture of the cooking chamber. A central air convection turbine inside the cooking chamber, attached to the center of the intermediate wall, scatters water with its blades to generate steam. There is at least one conducting duct for fumes from the combustion chamber, preferably in the form of a pair of pipes surrounding the blades of the central convection turbine, so that as the fumes pass through the pipes, they transmit to the surface of the pipes the heat necessary to vaporize the water scattered from the turbine blades.

A heat exchanger is connected to the steam generating pipes through a fume collector. The hot fumes flow through the interior of the fume collector in the direction opposite to that of a water feed coil. A flat fume takeup box is connected to the collector to return the combustion fumes to the cooking chamber. A water sprayer with a cylindrical pipe that is part of the central turbine shaft and whose open end projects beyond the plane of the turbine spins with the turbine to hurl the water over its blades.

A duct for exhausting steam is located outside the oven on one side of the oven roof and is provided with an electrically-actuated valve. The duct is in communication with the cooking chamber enclosure by means of an additional flat duct attached to the oven roof. A valveless fume flue is located on the side of the oven opposite the steam discharge duct.

Additional problems have been solved with the oven herein described. In order to exchange the heat of the fumes to generate steam before the fumes are exhausted, the fumes must be channelled outside the cooking chamber without escaping. At the same time, a means must be provided for shielding the burner and its control electrodes from the steam during the burner's extinction intervals when the set temperature has been reached and the burner is turned off, and also against soiling by grease, The foodstuffs themselves generate steam and other gases during their cooking, in proportion to the amount of food involved.

The duplicity of heat carriers in the cooking chamber atmosphere, fumes and steam, makes it mandatory that the oven be equipped with two separate exhaust ducts. In the convection and combined modes, the fume flue is closed. After the fumes have heated the surface of the steam generating pipes, the fumes are recovered to heat the cooking chamber through the flat takeup box. The fumes are drawn into the takeup box by the depression created by the convection turbine itself. The steam thus generated, and even the steam released by the foods themselves, are extracted through the steam exhaust duct. In the steam mode, however, it is necessary to keep the steam exhaust from the cooking chamber closed, due to the difficulty of achieving saturation, while the combustion fumes must be exhausted as they are produced.

Other additional problems solved by the oven include the speedy replacement of a deteriorated burner or electrodes. The construction of the oven provides prevention of the convection turbine's causing air turbulence in the burner flame. The possibility of the phenomenon of the flame's flowing back up inside the burner is also reduced by means of having the combustion chamber totally sealed off from the cooking chamber and attaching it, like the burner, directly to the intermediate wall of the oven.

The preheating of the water fed to the sprayer in the heat exchanger allows the broad exposed surface to be used to vaporize a greater amount of feed water than in known ovens, because in known ovens the water is fed in cold.

PREFERRED EMBODIMENT

Figure 1:
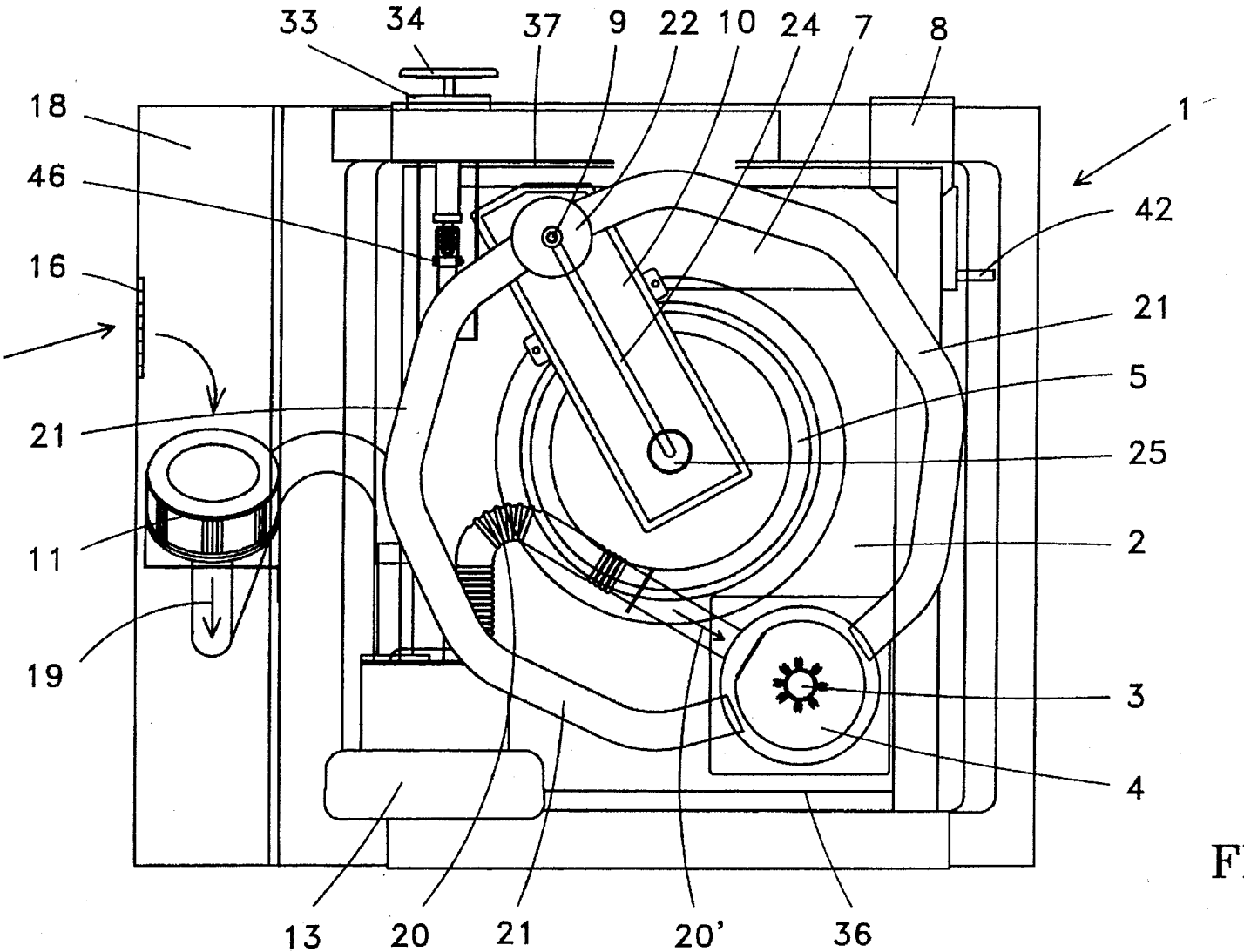
FIG. 1 is a front view of the inside of the commercial combined cooking oven object of the invention.
Figure 2:
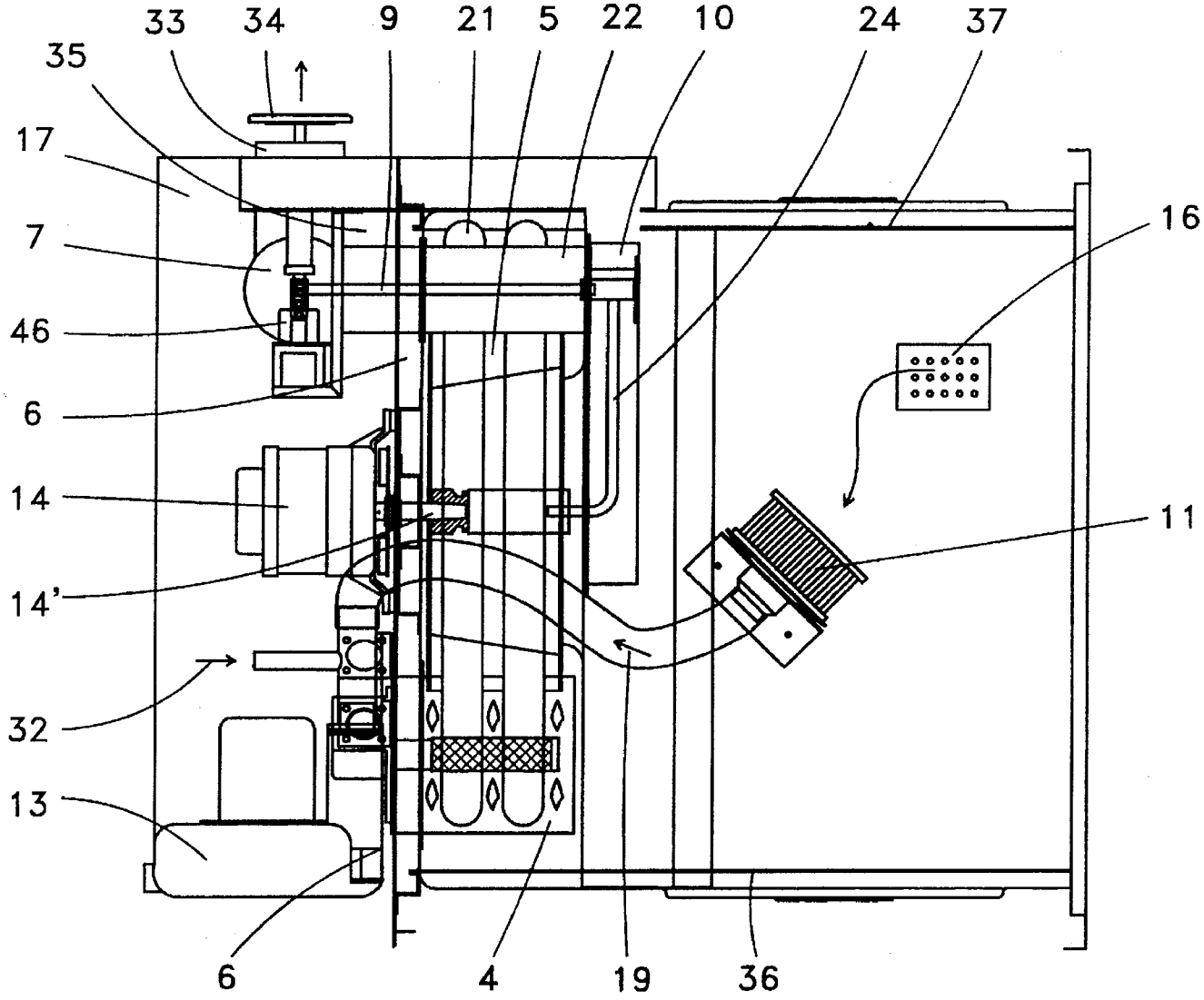
FIG. 2 is a side view of the inside of the oven in FIG. 1.
Figure 3:
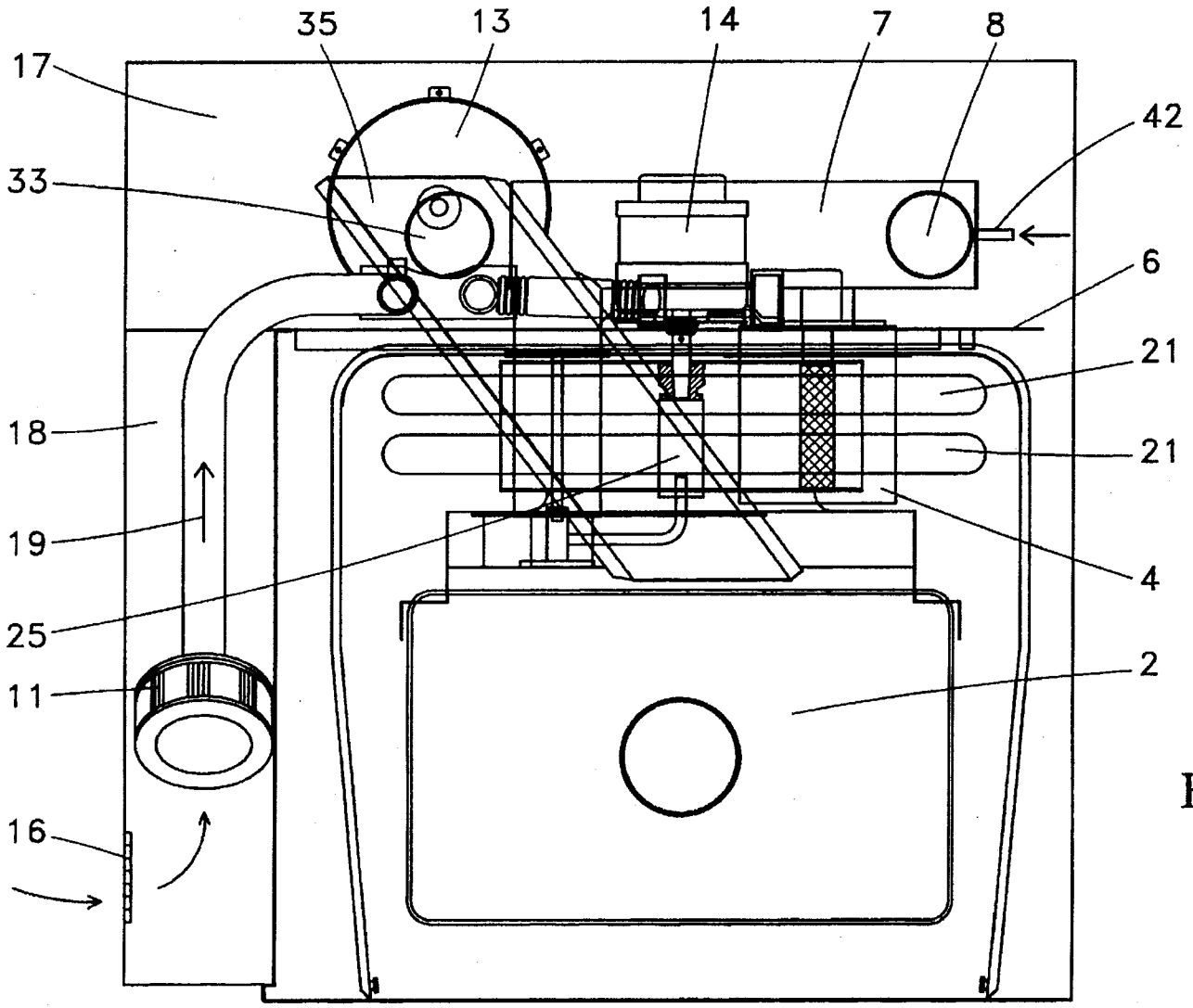
FIG. 3 is a top plan view of the inside of the oven in FIG. 1.

With reference to FIGS. 1 to 3, the commercial gas oven 1 which is the object of the present invention has a central cooking chamber 2 that is a square section on whose floor 36 at one side is positioned a cylindrical gas burner 3. The burner 3 is approximately 150 mm long and 32 mm in diameter, and can generate a power of 15,000 Kcal/hour. The burner is enclosed in a cylindrical combustion chamber 4.

A hot air convection turbine 5 is supported from a vertical intermediate wall 6 that defines the rear of the cooking chamber 2. The cylindrical heat exchanger 7 is positioned behind the vertical intermediate wall 6. A fume flue 8 is positioned next to one end of the heat exchanger 7, while from the other end of the exchanger there projects a hot water feed pipe 9. The feed pipe 9 runs through the fume collector 22, and is connected to the vertical hot water input line 24. Water flow 15 directs water into the sprayer 25.

Figure 4:
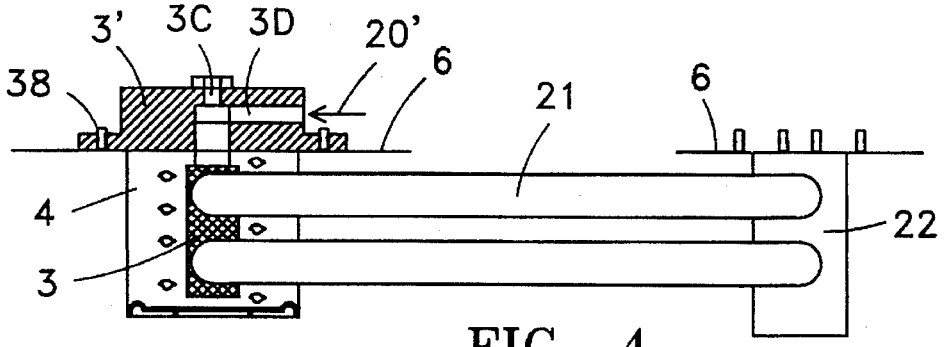
FIG. 4 is a side view of the means for generating the steam.

The gas burner 3, shown in detail in FIG. 4, is fed by a mixing device assisted by a premixing centrifugal blower 13. The blower 13, like the motor 14 of the turbine 5, is located at the rear 17 of the oven. The blower 13 draws in air from outside the oven through a grille 16 located on the outer side wall. The outer side wall forms with the wall of the cooking chamber 2 a side space 18 where a filter 11 is housed for intaking the combustion air. The filter 11 keeps the burner mesh 3 from becoming obstructed with grease and dust. This filtered air current 19 (FIG. 3) is mixed with the gas flow 32 (FIG. 2) before it reaches the blower 13, where the mixture 20' (FIG. 1) is homogenized and conveyed to the burner 3 by an extendable line 20.

The burner 3 and the combustion chamber 4, shown in FIG. 4, are sealed off and are attached to the vertical intermediate wall 6 of the oven by means of a molded aluminum burner base 3' with a front peephole **3*c* for monitoring the flame. The base 3' also includes a transverse inlet 3*d* for the fuel mixture 20'. The burner 3 can be easily detached via the bolts 38**.

The two pairs of steam-generating pipes 21 that form a fume circuit, shown in FIGS. 1 and 4, between the combustion chamber 4 and the collector 22 associated with the exchanger 7, are circular in cross section. Each pair extends transversely in parallel from one side of the combustion chamber 4, running around the central convection turbine 5, to form a ring whose shape is polygonal to facilitate pipe bending during manufacturing.

Figure 5:
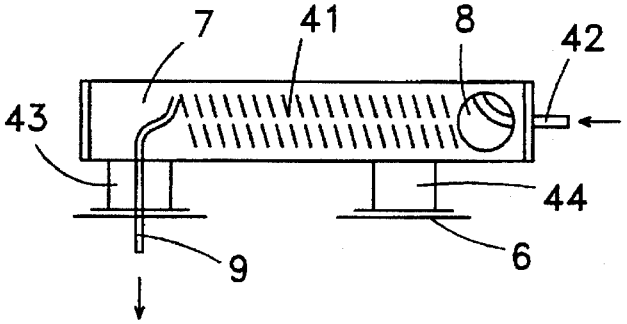
FIG. 5 is a top view of the fume/water heat exchanger.

The heat exchanger 7, shown in FIG. 5, is made of a hollow box with a circular cross section. The heat exchanger 7 is outfitted with a water coil 41 crossing it axially. The exchanger 7 is attached next to the oven roof 37 at the vertical wall 6 of the oven with a square bracket 44 at one end and a tap line 43 at the other end, through which it is connected to the collector 22. At one end the exchanger has a cold water inlet 42. That water is heated through the coil 41 by the fumes circulating from the collector 22. Hot water leaves the feed pipe 9 through the tap line 43 from the exchanger 7 to the takeup box 10.

Figure 6:
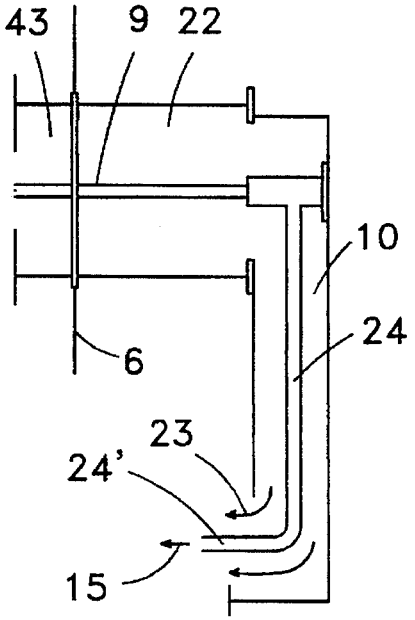
FIG. 6 is a longitudinal sectional view of the combustion fume takeup box, showing in its interior the hot water input pipe.

The fume takeup box 10, shown in FIGS. 1, 2 and 6, is rectangular and flat in shape, and forms part of the fume circuit. The takeup box 10 is connected to the fume collector 22 at the end opposite to the open flue 8 for exhausting fumes. The fumes are recovered after having heated the water in the coil 41 inside the exchanger 7 without having been exhausted to the outside because of the depression caused by the convection turbine 5 with respect to the exterior of the oven. The fumes are drawn in as shown by the arrows 23 to be blown by the turbine 5 to the cooking chamber 2. In the steam mode 28, the fumes are vented through the fume exhaust flue 8, because the steam exhaust duct 33 is closed and there is no such depression. The hot water input line 24 is connected to the pipe 9 of the collector 22 and runs through the inside of the fume takeup box 10 to pour out at its other bent end 24'. This creates the flow of water 15 inside the water sprayer 25.

Figure 7:
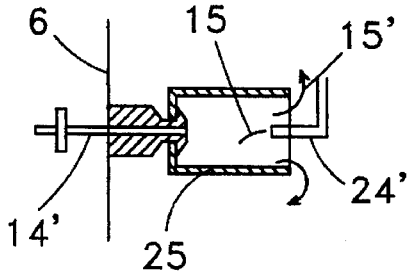
FIG. 7 is an axial section of the steam-generating water sprayer.

The water sprayer 25, shown in FIG. 7, is made of a cylindrical pipe which is integral to the central turbine shaft 14'. The sprayer 25 has its forward end open. The forward end projects beyond the vertical plane of the turbine. Inside the sprayer 25 the end 24' of the hot water input line 24 is aimed such that the sprayed water droplets are thrown off along the trajectories 15' toward the outside of the sprayer 25 with the help of the exhaust current of the turbine 5.

The exhaust duct 33 for convection air and steam is opened during the combined convection and steam modes 27, 29, 30 and after the cooking process has ended by means of the electric actuator of the valve 34 exhausting the steam to the outside. The actuator is an electromagnet device 46.

The circular duct 33 is located on the side opposite the side of the fume exhaust flue 8 of the exchanger 7. The duct 33 is connected to the cooking chamber's interior by means of a second duct 35 that is a flat steam inlet duct made of bent sheet metal with its square-bent edges attached to the roof 37 of the oven. The connection of the flat duct 35 to the cooking chamber 2 is made at an intermediate zone between the filter 11 and the blower 13 to obtain a high thermal rate.

Figure 8:
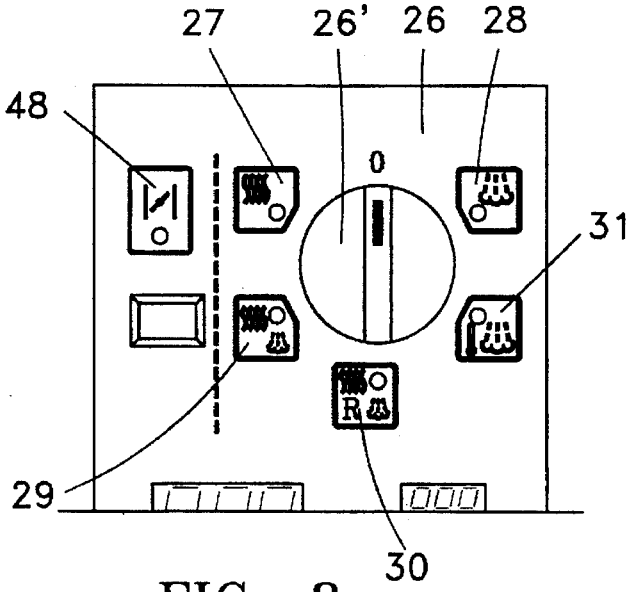
FIG. 8 is a partial view of the control panel showing the cooking mode switch.

The control panel 26, shown in FIG. 8, is marked at switch 26' for as many positions as there are cooking modes. The switch 26' has positions corresponding to the five modes the oven 1 provides. The five modes are possible due to the generation of a sufficient quantity of steam to reach saturation below 100° C., and to nearly reach the saturation point up to the temperature of at least 175° C. The modes are the "convection mode" 27, the "steam mode" 28, the "combined mode" 29, the "regeneration mode" 30, and the "smooth steam mode" 31. An indicator 48 tells whether the valve 34 of the steam exhaust duct 33 is open or closed.

The invention claimed is:

1. A commercial oven comprising:

an oven structure including an intermediate wall that defines a rear side of a cooking chamber, heating means including a combustion chamber with a gas burner therein, said gas burner is fed by a device that mixes gas and air, a turbine for the convection of air heated by said heating means into said cooking chamber, steam generating means including a water circuit that feeds a water sprayer coupled to a shaft of said turbine, said sprayer sprays water droplets onto blades of said turbine, and a conducting circuit in communication with said combustion chamber, said conducting circuit receives on a surface thereof said water droplets such that said water droplets are vaporized to supply steam to said cooking chamber, a flue for exhausting combustion fumes and a separate steam exhaust duct, and a cooking mode selector incorporated in a control panel; wherein said oven operates in a plurality of cooking modes, a user choosing via said control panel which of said cooking modes is activated, said cooking modes include hot air convection, steam, and hot air and steam combined.

2. The commercial oven according to claim 1, wherein:

the conducting circuit comprises at least one pair of steam generating pipes arranged around said turbine.

3. The commercial oven according to claim 1, wherein:

said water circuit for steam generation comprises a coil inside a heat exchanger where water is preheated by fumes from said combustion chamber.

4. The commercial oven according to claim 1, wherein:

fume ducts connect said combustion chamber and a fume collector, fumes from said combustion chamber are returned to said cooking chamber to heat said cooking chamber via a takeup duct connected to said fume collector.

5. A commercial oven comprising:

an oven structure forming a cooking chamber and equipped with an intermediate wall at a rear of said cooking chamber;

heating means including a combustion chamber, an extended mesh-type gas burner inside said combustion chamber sealed off from said cooking chamber and fed by a device that mixes gas and air and is equipped with a blower, and a turbine attached to said intermediate wall to force air into said cooking chamber;

steam generating means including a water feed circuit and a water sprayer coupled to a shaft of said convection turbine; and a flue for exhausting combustion fumes and a separate duct for exhausting steam.

6. The commercial oven according to claim 5, wherein:

said burner and said combustion chamber are attached to said intermediate wall of said oven by means of a molded aluminum base including a front peephole and a transverse fuel mixture intake, said molded aluminum base is easily removable so that said burner and said combustion chamber are also easily removable for repair and replacement.

7. The commercial oven according to claim 5, wherein:

said device that mixes gas and air draws in air from outside said oven via said blower through a filter positioned in a gap in an inner side of said oven.

8. The commercial oven according to claim 5, wherein:

said steam exhaust duct is equipped with an electrically-actuated valve and is located on a side of the oven opposite to said flue for exhausting fumes, said steam exhaust duct is connected to said cooking chamber through a flat duct attached to an oven roof.

9. A commercial oven comprising:

an oven structure including a cooking chamber, a gas burner inside a sealed combustion chamber as the only source of heat for said oven, a turbine for convection inside said cooking chamber, steam generating means including a water feed circuit and at least one combustion fume duct for generating steam, a funnel for venting combustion fumes, a steam discharge duct separate from said fume funnel and regulated by means of an electrically-actuated valve, and a cooking mode selector in a control panel; wherein said oven works in a plurality of cooking modes selected via said control panel, said modes including a convection mode, a steam mode, a combined mode, a freshening mode, and a cool steam mode.

* * * * *